US005571379A

United States Patent [19]

Derrick

[11] Patent Number: 5,571,379

[45] Date of Patent: Nov. 5, 1996

[54] COLLOIDAL COMPOSITION AND ITS USE IN THE PRODUCTION OF PAPER AND PAPERBOARD

[75] Inventor: Arthur P. Derrick, Cronulla, Australia

[73] Assignee: Laporte Industries Limited, London, United Kingdom

[21] Appl. No.: 485,852

[22] Filed: Jun. 7, 1995

Related U.S. Application Data

[62] Division of Ser. No. 133,452, Oct. 7, 1993, which is a division of Ser. No. 410,820, Sep. 22, 1989, Pat. No. 5,015,334.

[30] Foreign Application Priority Data

Dec. 10, 1988 [GB] United Kingdom ..... 8828899

[51] Int. Cl.[6] ..... D21H 21/10

[52] U.S. Cl. ..... 162/168.1; 162/181.6; 162/181.8; 162/183

[58] Field of Search ..... 162/181.6, 181.8, 162/183, 168.1, 168.2, 168.3, 164.3, 158

[56] References Cited

U.S. PATENT DOCUMENTS

| | | | |
|---|---|---|---|
| 2,795,545 | 6/1957 | Gluessenkamp | 162/181.8 |
| 4,569,920 | 2/1986 | Smith-Johannsen | 501/1 |
| 4,588,664 | 5/1986 | Fielding et al. | 430/1 |
| 4,629,572 | 12/1986 | Leitz et al. | 210/714 |
| 4,749,444 | 6/1988 | Lorz et al. | 162/168.3 |
| 4,753,710 | 6/1988 | Langley et al. | 162/164.3 |
| 4,913,775 | 4/1990 | Langley et al. | 162/164.3 |

*Primary Examiner*—Donald E. Czaja
*Assistant Examiner*—Jose A. Fortuna
*Attorney, Agent, or Firm*—Kane, Dalsimer, Sullivan, Kurucz, Levy, Eisele and Richard

[57] ABSTRACT

The composition comprises a water dispersible colloidal siliceous material, such as a swelling clay, in intimate association with a low molecular weight water soluble high charge density organic polymer, such as a polyacrylic acid or a polyamine, the ionicity of the siliceous material being significantly modified by the charge on the polymer. The composition may be produced by reacting the siliceous material and the organic polymer in an aqueous phase system at a concentration, for example, of from 5 to 25% by weight of the polymer on swelling clay solids. The composition is suitable for use as a retention/drainage agent in paper or paperboard production, preferably after the addition of a conventional high molecular weight flocculating agent.

2 Claims, No Drawings

COLLOIDAL COMPOSITION AND ITS USE IN THE PRODUCTION OF PAPER AND PAPERBOARD

This application is a division of application Ser. No. 08/133,452, filed Oct. 7, 1993 which is a division of Ser. No. 07/410,820 filed Sep. 22, 1989 (now U.S. Pat. No. 5,015, 334).

This invention relates to colloidal siliceous composition and to its use in a process for the production of paper and paperboard.

Conventional paper or paperboard manufacture involves forming a fibrous stock containing additives such as pigments, fillers and sizing agents and dewatering the stock on a metal or fabric wire to form the basis for the paper or board sheet. Such processes have been subject to the conflicting requirements that ready drainage of the stock should occur and that there should not be undue loss of additives and of fibre from the stock in the course of drainage, that is, that the retention of such additives and fibre on the wire should be high. This acts,.not only to give a saving in raw material costs and a reduction in the energy required to dry the sheet but also reduces effluent treatment requirements as a result of a lower content of suspended solids, and lower COD and BOD loadings, in the purge water. Sheet formation and surface properties may also be improved. There have been many attempts to optimise drainage and retention properties by the use of combinations of additives, which include polyelectrolytes such as high molecular weight polyacrylamide and its copolymers, which act as flocculating agents.

It has been proposed to use colloidal swelling clays in conjunction with the high molecular weight, relatively low charge density polyacrylamides which have traditionally been used as flocculants, which may be nonionic, anionic or cationic in nature and may be selected to suit the charge demand of the stock.

U.S. Pat. No. 3052595, for example, discloses the addition of bentonite to filled stock followed by an acrylamide homopolymer or copolymer which may include at most about 15% by weight of a functional comonomer which may be anionic or cationic in nature, corresponding to a charge density of at most about 2 m.eq./g. The affect of the above combination is that the polymer and the bentonite "are mutually activating whereby increased retention of the filler in the paper web and decreased turbidity of the resulting white water are obtained".

More recently, European Patent Specification No. 0017353 disclosed that the fibre retention and dewatering properties of substantially filler-free stocks may be improved dramatically by including in the stock a high molecular weight; e.g. a molecular weight essentially above 100,000, normally above 500,000 and generally about or above 1 million; polyacrylamide and a bentonite-type clay. The polyacrylamide may contain not more than 10% of either cationic or anionic units and is limited thereby to low charge density material.

This line of development has hitherto culminated in the process described in European Patent Specification No. 0235893 comprising adding a high molecular weight linear cationic polymer to thin stock in a quantity which is greater than that conventionally used to form large flocs, subjecting the flocculated suspension to significant shear and adding bentonite to the sheared suspension. It is explained that the effect of shearing is to break the flocs down into microflocs which are sufficiently stable to resist further degradation.

The present invention relates to paper and paperboard making processes in which the drainage and retention properties of the stock are modified by the use of an inorganic colloidal material, such as a swelling bentonite or other swelling clay, the colloidal material being of modified ionicity.

The invention may be employed in any paper-making process although one possible application of the invention is to the process described in European Patent Specification 0235893 or modifications thereof in which application improvements in retention and drainage properties have been demonstrated. Another example of a process involving the use of clays to which the present invention may be applied is that described in Finnish Patent No. 67736 which utilises a retention aid comprising a combination of a cationic polymer and an anionic material which may be a bentonite.

The modified colloidal material utilised according to this invention is a new composition capable of use even outside the papermaking industry in the many and diverse applications of swelling clays and like colloidal materials.

The modified colloidal material according to this invention comprises colloidal siliceous particles, for example of a swelling clay, characterised in that the ionicity of the colloidal particles is modified by intimate association with a low molecular weight water-soluble high charge density polymer.

The colloidal siliceous particles envisaged according to the invention comprise layered or three dimensional materials based on $SiO_4$ tetrahedra the layered materials being optionally interlayered with other materials such as alumina and/or magnesia octahedra. Layered materials particularly useful in the practice of this invention are the smectite family of clay minerals which are three-layer minerals containing a central layer of alumina or magnesia octahedra sandwiched between two layers of silica tetrahedra and have an idealised formula based on that of pyrophillite which has been modified by the replacement of some of the $Al^{+3}$, $Si^{+4}$, or $Mg^{+2}$ by cations of lower valency to give an overall anionic lattice charge. The smectite group of minerals includes montmorillonite; which includes sodium bentonite; beidellite, nontronite, saponite and hectorite. Such minerals preferably have a cation exchange capacity of from 80 to 150 m.eq/100 g dry mineral. For use according to the present invention the smectite minerals are preferably in the sodium or lithium form, which may occur naturally, but is more frequently obtained by cation exchange of naturally occurring alkaline earth clays, or in the hydrogen form which is obtainable by mineral acid treatment of alkali metal or alkaline earth metal clays. Such sodium, lithium or hydrogen-form clays generally have the property of increasing their basal spacing when hydrated to give the phenomenon known as swelling and are colloidally dispersed relatively easily. While swelling clays of natural origin are mainly envisaged synthetic analogues thereof are not excluded such as the synthetic hectorite material available from Laporte Industries Limited under the trade name LAPONITE.

In relation to these materials the term colloidal is used to indicate the ability to disperse, or be dispersed, in an aqueous medium to give a colloidal dispersion. Compositions according to the invention, however, need not be in the dispersed state and may, for example, be in a solid particulate form which may be dispersed into the colloidal state at or near the point of use. The size of colloidally dispersible particles is generally in the range $5\times10^{-7}$ cm to $250\times10^{-7}$ cm.

The low molecular weight water-soluble high charge density polymers utilised according to this invention have some or all of the following characteristics which contribute to their effectiveness.

(a) they are substantially linear, that is they contain no cross-linking chains or sufficiently few not to inhibit water-solubility, (b) they are either homopolymers of charged units or are copolymers containing more than 50%, preferably more than 75% and particularly preferably more than 85% of charged units, (c) they are of sufficiently low molecular weight to have water solubility. Preferably they have molecular weights below 100,000, but particularly preferably below 50,000 for example, particularly suitably, from 1000 to 10,000, as determined by Intrinsic Viscosity measurements or by Gel Permeation Chromatography techniques. They can preferably form aqueous solutions of at least 20% w/w concentration at ambient temperatures, (d) they have a high charge density, i.e. of at least 4 preferably of at least 7 and up to 24 m.eq/g. Particularly preferably the charge density is at least 8 and, for example up to 18 m.eq/g. The charge densities of anionic polymers may be determined by a modification of the method described by D. Horn in Progress in Colloid and Polymer Science Vol.65, 1978, pages 251–264 in which the polymer is titrated with DADMAC, a cationic polymer identified hereafter, to excess and then back-titrated with polyvinyl sulphonic acid. The same method, unmodified, may be used to determine the charge densities of cationic polymers.

Such polymers are not flocculants and would not normally be considered for use in paper-making processes.

Examples of anionic high charge density water-soluble polymers suitable for use herein are polyacrylic acid polymethacrylic acid polymaleic acid polyvinyl sulphonic acids polyhydroxy carboxylic acids polyaldehyde carboxylic acids alkyl acrylate/acrylic acid copolymers acrylamide/acrylic acid copolymers and salts, for example alkali metal or ammonium salts of any of the above.

Examples of suitable cationic high charge density water-soluble polymers are polyethyleneimines polyamidoamines polyvinylamines polydiallyl ammonium compounds.

The intimate association between the colloidal siliceous particles and the high charge density polymer which is required according to the present invention may be achieved by a variety of methods. One such method is dry mixing to provide a product which may be transported readily and dispersed in water on site. Alternatively, a dispersion may be produced by the addition of the colloidal siliceous particles to water containing the high charge density polymer. A concentrated dispersion of the modified colloidal siliceous particles according to this invention may be formed by the above methods for ready dilution for addition to paper stock, or may even be added directly to paper stock. Such concentrated dispersions, suitably but not essentially containing a surfactant and preservative and having a concentration based on the dry weight of the siliceous material of at least 50 g/liter but up to the maximum concentration which is pumpable and preferably above 100 g/l and up to for example 250 g/l, are particularly advantageous embodiments of the present invention.

An alternative method of carrying out the invention is to add the colloidal siliceous material and the water-soluble high charge density polymer species successively, in either order of preference, directly to the stock or to a portion of the stock which has been withdrawn temporarily from the process. Successive addition implies that there should preferably be no significant shear, significant stock dilution, e.g. by more than about 20%, or addition of flocculant, between the addition of the siliceous particles and the high charge density polymers. This may be a less efficient embodiment of the invention since the large volume of water present may delay or prevent, to an extent, the association of those species..

It has been found that the colloidal siliceous particles and the water soluble high charge density polymer interact to form composite colloidal species even when, as is preferred, the high charge density polymer is anionic and the colloidal siliceous particles are swelling clay particles based on an anionic lattice by virtue of substitutions in the octahedral layers. The nature of the interaction is not known but may be due to hydrogen bonding involving hydroxyl ions on the clay lattice. The examination of the composite colloidal particles according to the invention by electrophoretic techniques, for example as described below, shows that the siliceous particles and the polymer molecules exist as a single entity in aqueous dispersion and move only as a single species through the electrophoretic cell and, further, that the ionicity of the siliceous particles has been modified by that of the polymer as shown by an alteration in the velocity of the composite particles from that of unmodified particles of the siliceous material.

In the following tests for electrophoretic mobility particles were timed for 5 graticule spacings. The timing distance over 5 graticules was 0.25 min. The electrode data was:

Applied Potential (V)=90 V

Interelectrode Distance (I)=75 mm

Applied Field (E)=1250 $VM^{-1}$

The samples to be tested were prepared as follows. A sodium-form swelling montmorillonite (FULGEL 100 ) was washed and dried and samples were slurried at a concentration of 1 g/l in demineralised water and, separately, in 0.01 molar sodium chloride solution each at the natural pH of 9.8 and 9.6 respectively. The sodium chloride addition was to simulate the ionic content of a paper stock. Additionally, a similar slurry in 0.01 molar sodium chloride but adjusted with ammonium chloride to a pH of 7.0 to simulate conditions in a neutral paper stock was prepared. The procedure was repeated using the same clay which had been modified by reaction according to the invention with an anionic water soluble polymer comprising a neutralised polyacrylic acid having a charge density of 13.7m.eq./g and a molecular weight of 2500 at a loading of 10% by weight of the clay.

The electrophoretic mobilities of these six samples, in every instance towards the positive electrode, was as follows (units$\times 10_{-8}=M_2S^{-1}V^{-1}$).

| | Clay | Clay/anionic polymer | % increase |
|---|---|---|---|
| pH 9.8 Demin. water | 3.67 | 5.10 | 39 |
| 9.6 NaCl | 2.52 | 3.59 | 56 |
| pH 7 NaCl | 2.30 | 3.84 | 67 |

Thus, in the case of an anionic swelling clay and an organic polymer, for example, the natural lattice charge may be increased by, for example, up to about 70%, the amount of the increase being determinable by the charge density of the polymer and the quantity of polymer, but being preferably at least 10%, particularly preferably at least 20%. Similarly, it is envisaged that a charge could be given to a siliceous material having a nett nil change such as silica.

In a further series of tests conducted under the same conditions the electrophoretic mobility was determined of the same swelling clay which had been reacted according to the invention with the low molecular weight cationic polymer polydiallyldimethyl ammonium chloride having a charge density of 6 m.eq./g. In every instance the composite clay/polymer particles moved towards the negative electrode with the electrophoretic mobilities, in the same units, set out below.

| pH | Medium | Mobility |
|---|---|---|
| 10 | Demin. water | 2.89 |
| 7 | " | 2.00 |
| 4 | " | 1.62 |
| 10 | .01molarNaCl | 3.69 |
| 7 | " | 3.24 |
| 4 | " | 2.75 |

Preferably the polymer is used in from 0.5% to 25% on the dry weight of the siliceous material, particularly preferably from 2% to 10% on the same basis.

In the application of the present invention to paper-making processes the modified colloidal material of the invention is preferably incorporated with the thin stock prior, for example from 1 to 20 seconds prior, to its entry to the headbox or machine vats. The level of addition may be that usual in the art for swelling clays for example from 0.05% to 2.5% by weight of the siliceous material based on the weight of the furnish solids but may be optimised by conducting standard retention and drainage tests on the treated stock. Excessive addition can result in peptisation and partial dispersion of the preflocculated stock with resulting fall-off of retention and drainage properties.

The invention may be utilised in acid or neutral paper-making systems following on the normal application of high molecular weight cationic flocculants in which systems anionically modified material according to the invention are preferably utilised. Cationically modified material according to the invention may suitably be utilised in alkaline paper-making systems e.g. those using calcium carbonate filler and operating at a pH of around 8. The invention is applicable however to a wide range of paper-making processes and stocks including those for the production of writing and printing papers, bond and bank grades, newsprint, liner board, security and computer paper, photocopy paper, sack paper, filler board, white lined carbon, wrapping/packaging paper, plasterboard, box board, corrugated board, towelling and tissue papers.

Other additives usually used in the manufacture of paper or paperboard are compatible with the present invention. Among such additives are fillers, clays (non-swelling), pigments such as titanium dioxide, precipitated/ground calcite, gypsum, sizes such as rosin/alum or synthetic sizes such as the alkylketene dimers or alkyl succinic anhydrides, wet or dry strength resins, dyes, optical brighteners and slimicides.

The present invention will now be illustrated by reference to the following tests in which the performance of the present invention was compared with the conventional use of polymeric flocculants and with the process described in European Patent Specification No. 0235893 in which specification a flocculated suspension is subjected to shear and the sheared suspension was treated with bentonite. It is noted that, apart from the improvement in retention and drainage documented in the following tests, a further advantage of the present invention is the capability of giving excellent results even when the flocculated suspension is not subjected to the significant shear stage deemed to be essential according to European Patent Specification No. 0235893.

Britt Jar testing procedures for measuring fines retention (TAPPI Method T.261, 1980) and drainage tests using Schopper Riegler equipment were used. A standard volume of stock was introduced into a standard Britt Jar apparatus and a cationic high molecular weight polymeric flocculant was added in a given quantity followed either by gentle (500 rpm) mixing or by shear mixing (1500 rpm) for 30 seconds. After the slow mixing no reduction of floc size, i.e. shear of the flocs, was observed in any of the tests reported in this specification. After this mixing stage in some tests a given quantity of a commercial swelling clay was added in the form of a concentrated dispersion in water. In some further tests a polymer modified clay according to the invention was added as a preformed dispersion. The modified clay was produced by combining the swelling clay in, for example, the $H^+$or $Na^+$form with a concentrated solution of the high charge density polymer species at a polymer to clay weight ratio of which could be from about 1% to 20%. For convenience such dispersions were produce in the concentrated form and diluted to a 10 g/l dispersion for addition to the stock. Suitable products according to this invention were also produced by contacting the clay with a concentrated solution of a high charge density polycationic species in high intensity dry mixing equipment. The clay or modified clay were mixed in by gentle 500 rpm mixing for 15 seconds and the retention and/or drainage tests performed to give results expressed as % fines retained by weight of originally present fines and, in the case of the drainage test, as the time in seconds to drain 500ml of white water from a 1 liter sample of treated stock.

Tests 1–40

In the following series of tests the cationic polymer flocculant was an acrylamide copolymer with dimethyl aminoethyl acrylate quaternised with methyl chloride and having an acrylamide/aminoethyl acrylate molar ratio of 86/14. It had a charge density of less than 2m.eq/g and an intrinsic viscosity of 7 deciliters/minute. The swelling clay was a substantially wholly sodium exchanged calcium montmorillonite available from Laporte Industries Limited as Fulgel 100 (Fulgel is a Trade Name). Where a modified clay was used it was produced by dispersing the clay in a concentrated solution of a high charge density anionic polymer and diluting to 10 g/l concentration as described above. The high charge density polymer was polyacrylic acid having a molecular weight of about 5000 and an anionic charge density of 13 m.eq/g. The stock used in tests 1 to 18 was a bleached fine paper stock containing softwood Kraft and hardwood Kraft stocks in a 25/75 weight ratio and a clay filler in about 15%, sized with a cationic rosin emulsion (2% on fibre) followed by alum. The stock was reconstituted by mixing 2,521 thick stock (consistency 5.33, pH 5.0) with 17.51 white water (pH 4.2) to give a consistency of 0.77%, a pH of 4.4 and a fines fraction of 38.6%. In tests 19–40 a similar but not identical stock having a consistency of 0.77% and a fines fraction of 36.6% was used. In the following Tables the % of the cationic flocculant and of the swelling clay are each based on the weight of the furnish solids while the % of the anionic polymer in the modified clay is based on the dry weight of the clay. In the "Shear" column the symbol "○" indicates the gentle mixing and the symbol "+" indicates shear mixing. Tests 7–12, 29 to 31, 39 and 40 are according to the present invention.

Tests 32–35 use finely divided Kaolin Clay (KC) or fine ground Vermiculite (V) in place of the Bentonite.

| Test No. | Cationic flocculant (wt % furnish solids) | Shear | Clay (wt % furnish solids) | Polymer (wt % clay) | Fines Retn. (wt %) |
|---|---|---|---|---|---|
| 1 | 0.05 | o | 0.1 | — | 70.9 |
| 2 | 0.05 | o | 0.2 | — | 75.6 |
| 3 | 0.05 | o | 0.35 | — | 75.4 |
| 4 | 0.05 | + | 0.1 | — | 69.9 |
| 5 | 0.05 | + | 0.2 | — | 71.5 |
| 6 | 0.05 | + | 0.3 | — | 76.2 |
| 7 | 0.05 | o | 0.1 | 10 | 76.0 |
| 8 | 0.05 | o | 0.2 | 10 | 78.2 |
| 9 | 0.05 | o | 0.3 | 10 | 79.2 |
| 10 | 0.05 | + | 0.1 | 10 | 79.2 |
| 11 | 0.05 | + | 0.2 | 10 | 81.4 |
| 12 | 0.05 | + | 0.3 | 10 | 75.2 |
| 13 | 0.05 | o | — | 0.01" | 67.7 |
| 14 | 0.05 | o | — | 0.03" | 65.5 |
| 15 | 0.05 | o | — | 0.05" | 60.8 |
| 16 | 0.05 | + | — | 0.01" | 62.2 |
| 17 | 0.05 | + | — | 0.03" | 58.5 |
| 18 | 0.05 | + | — | 0.05" | 67.3 |
| 19 | — | o | — | — | 57.3 |
| 20 | 0.05 | o | — | — | 80.6 |
| 21 | 0.075 | o | — | — | 80.7 |
| 22 | 0.1 | o | — | — | 73.3 |
| 23 | 0.05 | + | — | — | 77.3 |
| 24 | 0.075 | + | — | — | 68.1 |
| 25 | 0.1 | + | — | — | 76.2 |
| 26 | 0.5 | + | 0.3 | — | 82.8 |
| 27 | 0.75 | + | 0.3 | — | 79.8 |
| 28 | 0.1 | + | 0.3 | — | 82.4 |
| 29 | 0.5 | + | 0.15 | 10 | 87.0 |
| 30 | 0.70 | + | 0.15 | 10 | 85.9 |
| 31 | 0.1 | + | 0.15 | 10 | 85.7 |
| 32 | 0.05 | + | 0.3 (KC) | — | 63.9 |
| 33 | 0.05 | + | 0.3 (V) | — | 69.3 |
| 34 | 0.05 | + | 0.3 (KC) | 10 | 73.4 |
| 35 | 0.05 | + | 0.3 (V) | 10 | 71.0 |
| | | | | | Schopper Riegler (secs) |
| 36 | — | o | — | — | 19.6 |
| 37 | 0.05 | o | — | — | 17.5 |
| 38 | 0.05 | o | 0.2* | — | 15.0 |
| 39 | 0.05 | o | 0.2* | 10 | 11.7 |
| 40 | 0.05 | o | 0.2* | 5 | 11.5 |

" = % by weight of the furnish solids.
* = followed by 30 seconds shear at 1500 rpm.

Tests 41–48

In the following series of tests using the same procedure as tests 1–40 a 100% recycled waste stock for box board container middles was used. It had been sized with a stearyl ketene dimer at 1% level. In reconstituted form it had a fines fraction of 26%, a consistency of 0.5% and a pH of 7.0. The same cationic flocculant and swelling clay was used as in the previous tests. Tests 45–48 are according to the invention. In Tests 47 and 48 the polyacrylic acid was the same as that previously used and in Tests 45 and 46 sodium polyacrylate having a similar charge density was used.

| Test No. | Cationic flocculant (wt % furnish solids) | Shear | Clay (Wt % furnish solids) | Polymer (Wt % clay) | Retn. (wt %) | Schopper Riegler (secs) |
|---|---|---|---|---|---|---|
| 41 | — | o | — | — | 69.5 | 32.5 |
| 42 | 0.05 | + | — | — | 86.4 | 22.5 |
| 43 | 0.05 | + | 0.1 | — | 88.0 | |
| 44 | 0.05 | + | 0.2 | — | 90.1 | 19.7 |
| 45 | 0.05 | + | 0.1 | 10 | 93.7 | |
| 46 | 0.05 | + | 0.2 | 10 | 95.1 | |
| 47 | 0.05 | + | 0.1 | 10 | 92.4 | |
| 48 | 0.05 | + | 0.2 | 10 | 94.1 | 17.2 |

Tests 49–64

In the following tests using the same procedure, a similar Stock to that used in Tests 41–48 having a fines fraction of 30.6% was used.

In each instance 0.03% of the same cationic flocculant was added to the stock followed by shearing at 1500 rpm for seconds. Then the indicated quantity of Fulgel 100 swelling clay (as such or modified by the presence in intimate association with the clay of 10% on the dry weight of the clay of the indicated high charge density polymer) was added followed by gentle mixing. The Fines Retention found is set out in the following Table. Tests 51–58 and 61 to 64 are according to the invention.

| Test No. | Swelling Clay % wt | Anionic polymer | Fines Retn. % |
|---|---|---|---|
| 49 | 0.1 | — | 80.1 |
| 50 | 0.2 | — | 81.4 |
| 51 | 0.1 | Na polyacrylate | 84.8 |
| 52 | 0.2 | Na polyacrylate | 88.2 |
| 53 | 0.1 | Polyacrylic acid | 86.2 |
| 54 | 0.2 | Polyacrylic acid | 89.0 |
| 55 | 0.1 | Polymaleic acid | 83.9 |
| 56 | 0.2 | Polymaleic acid | 86.2 |
| 57 | 0.1 | Polyvinyl sulphonic acid | 84.3 |
| 58 | 0.2 | Polyvinyl sulphonic acid | 85.8 |
| 59 | 0.1 | Sodium Polyacrylate | 82.0 |
| 60 | 0.2 | Sodium Polyacrylate (High m. wt) | 83.2 |
| 61 | 0.1 ) | Poly DADMAC | 77.0 |
| 62 | 0.2 ) | (Cationic) | 81.7 |
| 63 | 0.1 | Polyrain SK (cationic) | 76.2 |
| 64 | 0.2 | Polyrain SK (cationic) | 76.5 |

The sodium polyacrylate and the polyacrylic acid were those used in the previous Tests except for those used in Tests 59, 60 which had a molecular weight of about 15 million and a charge density of 10 me/g. The molecular weights and the charge densities of the polymaleic acid were 1000 and 16 m.eq./g and of the polyvinyl sulphonic acid were 2000 and 13 m.eq./g respectively. DADMAC is polydiallyldimethyl ammonium chloride which is cationic as is the Polymin SK (Trade Name) which is a polyamidoamine. The charge densities of these materials was 6 m.eq./g and 7 m.eq./g respectively.

Tests 65–68

The following Tests were carried out using different processing regimes in terms of order of addition of the system components. Unless otherwise stated 0.03% of the cationic flocculant was used. The stock was a Newsprint stock comprising 35% Virgin CTMP pulp and 65% deinked waste.

The reconstituted Stock had a consistency of 0.33%, a pH of 5.7 and a fines fraction of 70.3%. Test 65 is according to the invention.

| Test No. | |
|---|---|
| 65 | The cationic flocculant was followed by shear mixing at 1500 rpm for 30 seconds and then 0.2% by weight of the furnish solids of the Fulgel 100 was added followed by gentle mixing at 500 rpm for 15 seconds and then 0.02% by weight of furnish solids of the polyacrylic acid were added again followed by gentle mixing. The % fines retention found was 88.6%. |
| 66 | Test 66 was varied by including the Fulgel 100 clay with the cationic flocculant. The % retention found was 83.5. |
| 67 | Test 65 was varied by omitting the Fulgel 100 clay. The % retention was 80.0%. |
| 68 | Test 65 was varied by adding the Fulgel 100 clay and the polyacrylic acid first, followed by mixing at 500 rpm for 15 seconds and then by the cationic flocculant which was followed by shear mixing at 1500 rpm for 30 seconds. The % fines retention was 59.4. |

Tests 69–76

In a further series of tests a similar stock to that used in Tests 1–40 having a consistency of 0.79% was used.

In every Test, except 69, 0.05% of the same cationic flocculant by weight of the furnish solids was added to the stock followed by gentle mixing (Britt Jar 500 rpm) for 30 seconds and then, in Tests 71–76, 0.2% on the same basis of a dispersion of swelling clay followed by gentle mixing for 15 seconds. The clays used and the retention and drainage properties of the resulting web are summarised in the following Table. Tests 74–76 are according to the invention and in these tests the $H^+$form acid activated clays were added as an aqueous dispersion also containing 10%, by weight of the clay, of the polyacrylic acid used in Tests 1–40. In further experiments in which the same clays were separated from the polyacrylic acid containing dispersion and subjected to analysis it was shown that the polyacrylic acid was substantially all adsorbed on the clay.

Test 69 is a control test on the untreated stock (no cationic flocculant, mixing, or clay addition).

| Test No. | Swelling Clay | % Fines Retn. | Schopper Riegler |
|---|---|---|---|
| 69 | Control | 50.1 | 43 |
| 70 | No swelling clay added | 71.9 | 32 |
| 71 | Acid activated Wyoming Bentonite | 79.0 | — |
| 72 | Acid activated Los Trancos Bentonite | 77.5 | — |
| 73 | Acid activated Spanish Bentonite | 78.7 | — |
| 74 | As Test 71 but using modified clay | 85.4 | — |
| 75 | As Test 72 but using modified clay | 83.0 | — |
| 76 | As Test 73 but using modified clay | 83.4 | 29 |

Wyoming bentonite is a naturally occurring substantially homoionic sodium bentonite. Los Trancos and Spanish bentonites were alkaline earth bentonites converted substantially to the hydrogen form by acid activation.

Tests 77–79

These tests using headbox stock from a fine paper mill were conducted on a full pilot scale using a 92 cm wide (84 cm Deckle) conventional Fourdrinier machine manufactured by Sandy Hill Corp USA. The machine speed for the tests was 15.24 meters/minute and the basis weight was 80–85 $gm^2$. The stock used had a fiber furnish of bleached kraft (22% pine, 23% hardwood), broke 30% and transition stock 25% and contained fortified rosin emulsion size (5 kg/tonne), alum (9 kg/tonne),caustic soda (0.5 kg/tonne) and a kaolin clay (non-swelling)/titanium dioxide filler at a loading of 100 kg/tonne. As received, consistency was 0.41%, pH 4.3 and stuff box freeness 365.

Tests 77 and 79 were initial and final blank runs with no further additives to the stock. Test 78 was according to the invention and involved the introduction of 0.3 kg/tonne of a high molecular weight cationic polymer, available from Vinings Industries Inc. as PROFLOC 1510 and having a charge density well below 2 m.eq./g, immediately after the fan pump (the last point of shear before the headbox) and, at a point immediately before the headbox, at a rate of 1.5 kg/tonne on a solids basis, a 10 g/l concentration dispersion containing a swelling sodium bentonite which had been treated according to the invention at a level of 10% on a dry clay basis with an anionic polymer consisting of neutralised polyacrylic acid having a molecular weight of 2500 and a charge density of 13 m.eq./g. There was no addition of shear between the addition of the cationic polymer and the polymer loaded bentonite.

The retention results given by the three tests were as follows:

| Test | Tray Water | White Water |
|---|---|---|
| | % First Pass Retention | |
| 77 (Blank) | 84 | 84 |
| 78 (Invention) | 95 | 95 |
| 79 (Blank) | 85 | 85 |
| | % Fines Retention | |
| 77 (Blank) | 61 | 66 |
| 78 (Invention) | 87 | 87 |
| 79 (Blank) | 63 | 64 |

Tests 80–82

A further series of tests were also conducted on the above pilot scale Fourdrinier machine using a newsprint furnish from an operating mill. Machine speed was 45.7 meter/minute and the basis weight of produced paper was set at 48 to 49 gsm. As received the Southern pine furnish was as follows: kraft 27.2%, theromechanical pulp 52.0%, groundwood pulp 20.8%, broke 3.4%. Consistency 1.08%, pH 4.2 and stuff box CSF-92.

Test 80 was a no treatment blank. Test 81 involved the introduction of 0.2 kg/tonne of a high molecular weight cationic polymer available from Vinings Industries, Inc. as "ProFloc" 1545, having a charge density well below 2 m.e./g. immediately after the fan pump. Test 82 was as per Test 81 but with the sequential addition of 1.5 kg/tonne of an anionic polymer treated bentonite according to the invention to an injection point immediately prior to the machine headbox.

Typical results for this series of tests were as follows:

| Test | |
|---|---|
| | % First Pass Retention |
| 80 (Blank) | 74 |
| 81 (Polymer Retention Aid only) | 82 |
| 82 (Invention) | 86 |
| | % Reduction in White Water Solids |
| 80 (Blank) | 0 (Base) |
| 81 (Polymer Retention Aid only) | 27.6 |
| 82 (Invention) | 43.4 |

These dynamic machine examples illustrate that the invention can give good results on a pilot scale despite the lack of shear or mixing other than the limited natural turbulence of the thin stock itself passing to the headbox of the Fourdrinier machine.

I claim:

1. A process for the production of paper or paperboard, which comprises;

introducing into thin stock prior to the entry of said stock into a headbox or machine vats a retention or drainage agent consisting essentially of; particles of a colloidally dispersible siliceous material selected from clay or silica, said particles being in intimate association with a water molecules of a water-soluble cationic organic polymer having a molecular weight of from 1,000 to below 50,000 and a cationic charge density of from 4 to 24 meg/g, the amount of water soluble organic polymer being effective to give composite colloidal particles having an electrophoretic mobility towards a negative electrode.

2. A process as claimed in claim 1 wherein a high molecular weight flocculant is introduced into the paper or paperboard pulp or stock, prior to the addition to the thin stock of the retention or drainage agent.

* * * * *